US007245843B2

(12) United States Patent
Bessho

(10) Patent No.: US 7,245,843 B2
(45) Date of Patent: Jul. 17, 2007

(54) IMAGE FORMING APPARATUS CAPABLE OF OPTIMIZING GLOSSINESS OF IMAGE FORMED ON RECORDING MATERIAL WITH TRANSPARENT OR WHITE TONER

(75) Inventor: Yuji Bessho, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 241 days.

(21) Appl. No.: 11/085,558

(22) Filed: Mar. 22, 2005

(65) Prior Publication Data

US 2005/0214006 A1 Sep. 29, 2005

(30) Foreign Application Priority Data

Mar. 26, 2004 (JP) ..... 2004-091627

(51) Int. Cl.
*G03G 15/00* (2006.01)

(52) U.S. Cl. ..... 399/49

(58) Field of Classification Search ..... 399/49, 399/53–55

See application file for complete search history.

(56) References Cited

U.S. PATENT DOCUMENTS

| | | | | |
|---|---|---|---|---|
| 5,260,753 | A * | 11/1993 | Haneda et al. | 399/54 |
| 5,751,432 | A * | 5/1998 | Gwaltney | 358/296 |
| 6,535,712 | B2 * | 3/2003 | Richards | 399/341 |

FOREIGN PATENT DOCUMENTS

| | | |
|---|---|---|
| JP | 63-58374 | 3/1988 |
| JP | 63-259575 | 10/1988 |
| JP | 3-27650 | 2/1991 |
| JP | 4-204670 | 7/1992 |
| JP | 4-278967 | 10/1992 |
| JP | 5-142963 | 6/1993 |
| JP | 5-232840 | 9/1993 |
| JP | 7-72696 | 3/1995 |
| JP | 11-7174 | 1/1999 |
| JP | 11-249365 | 9/1999 |
| JP | 11-249375 | 9/1999 |
| JP | 2004-70010 | 3/2004 |

* cited by examiner

*Primary Examiner*—David M. Gray
*Assistant Examiner*—Ryan Gleitz
(74) *Attorney, Agent, or Firm*—Fitzpatrick, Cella, Harper & Scinto

(57) ABSTRACT

An image forming apparatus includes a toner image forming device for forming a toner image on a recording material with transparent or white toner. A fixing device fixes the toner image on the recording material. A fixed toner image detection device detects the toner image fixed on the recording material. A controller variably controls a toner image forming condition of the toner image forming device on the basis of a detection result of the fixed toner image detection device, which detects a glossiness of the toner image. The toner image forming condition, which is variably controlled by the controller, is a weight of the toner per unit area of the toner image on the recording material.

9 Claims, 6 Drawing Sheets

IMAGE FORMING APPARATUS CAPABLE OF OPTIMIZING GLOSSINESS OF IMAGE FORMED ON RECORDING MATERIAL WITH TRANSPARENT OR WHITE TONER

FIELD OF THE INVENTION AND RELATED ART

The present invention relates to an image forming apparatus using a transparent or white toner image, particularly an image forming apparatus capable of uniformizing a glossiness of the toner image formed on a recording material.

In recent years, users' demands on image qualities of an electrophotographic image forming apparatus have been diversified. Particularly, a highly glossy image such as a photographic image has been required.

Japanese Laid-Open Patent Application Hei 11-249375 has disclosed an image forming apparatus employing toner image in order to obtain an image having a high glossiness. In the image forming apparatus, a glossiness of a recording material is measured and on the basis of a measurement result, a condition for forming a transparent toner image is controlled.

However, in the above mentioned image forming apparatus, it is difficult to form a transparent toner image having a desired glossiness on the recording material. As a result, the image forming apparatus has accompanied with such a problem that the glossiness of the image-formed recording material becomes nonuniform.

SUMMARY OF THE INVENTION

An object of the present invention is to provide an image forming apparatus, using transparent or white toner in order to obtain a highly glossy image, which can uniformize a glossiness of a recording material on which a transparent or white toner image having a desired glossiness is formed.

According to an aspect of the present invention, there is provided an image forming apparatus, comprising:

toner image forming means for forming a toner image on a recording material with transparent or white toner, fixing means for fixing the toner image on the recording material, fixed toner image detection means for detecting the toner image fixed on the recording material, and control means for variably controlling a toner image forming condition of the toner image forming means on the basis of a detection result of the fixed toner image detection means.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
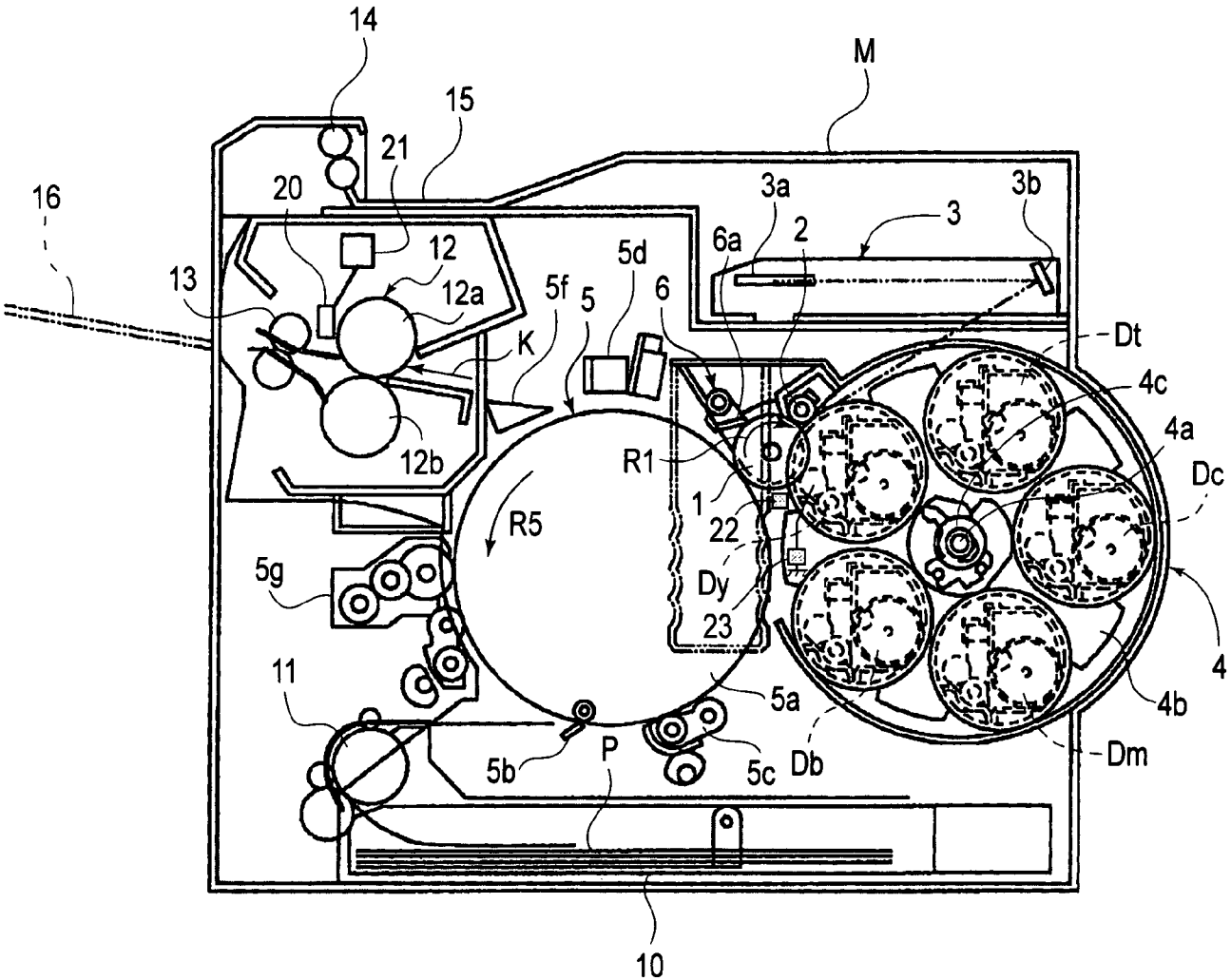
FIG. 1 is a longitudinal cross-sectional view showing a schematic structure of the image forming apparatus according to the present invention.

In the present invention, a toner image of transparent or white toner is formed on a recording material and fixed thereon by a fixing means. Further, the transparent or white toner image fixed on the recording material is detected by a fixed toner image detection means. On the basis of a detection result of the fixed toner image detection means, the above described problem has been solved by variably controlling a condition for forming the transparent or white toner image on the recording material.

More specifically, a glossiness of the toner image fixed on the recording material is largely affected by a surface roughness of the toner image. Further, the surface roughness of the toner image varies depending on a surface roughness of the recording material, an amount (weight) of the toner per unit area of the toner image on the recording material, etc.

However, from a glossiness of the recording material, the surface roughness of the recording material cannot be accurately determined, so that the transparent or white toner image cannot be formed on the recording material under a tone image forming condition suitable for the recording material surface roughness. As a result, the above described problem arises.

According to the image forming apparatus of the present invention, it becomes possible to obtain a toner image forming condition corresponding to a surface roughness of a recording material used for image formation by detecting a glossiness of the transparent or white toner used for image formation by detecting a glossiness of the transparent or white toner image fixed on the recording material. By appropriately controlling this toner image forming condition, the transparent or white toner image is formed on the recording material to solve the above described problem.

Hereinbelow, embodiments of the present invention will be described in detail with reference to the drawings.

In the drawings, members or means represented by identical reference numerals or symbols have the same structures and functions, thus being appropriately omitted from repetitive explanation.

Embodiment 1

FIG. 1 shows an embodiment of the image forming apparatus according to the present invention. The image forming apparatus shown in FIG. 1 is of a full-color electrophotographic type.

A general structure of the image forming apparatus will be described with reference to FIG. 1.

The image forming apparatus shown in FIG. 1 is provided with a drum-type electrophotographic photosensitive member (hereinafter referred to as "photosensitive drum") 1 as an image bearing member in a main assembly M of the image forming apparatus. The photosensitive drum 1 is rotationally driven by a drive means (not shown) in a direction of an arrow R1. Around the photosensitive drum 1, a charge roller 2 as a charging means, an exposure apparatus 3 as an electrostatic latent image forming means, a developing apparatus 4 as a developing means, a transfer apparatus 5 as a transfer means, and a cleaning apparatus 6 as a cleaning means are disposed substantially in this order in the rotation direction (the arrow R1 direction) of the photosensitive drum 1. Below the transfer apparatus 5, a paper (sheet) feeding cassette 10 for containing therein a recording material P and a paper feeding roller 11 for feeding the recording material P one by one from the paper feeding cassette 10 are disposed. A toner image forming means is constituted by the photosensitive drum 1, the charge roller 2, the exposure apparatus 3, the developing apparatus 4, and the transfer apparatus 5, and forms a toner image on the recording material P.

Obliquely above the transfer apparatus 5 in FIG. 1, a fixing apparatus 12, which has a fixation roller 12*a* and a pressure roller 12*b*, as a fixing means; paper discharge (output) rollers 13 and 14; a face-down paper discharge tray 15; and a face-up paper discharge tray 16 are disposed. Further, on a downstream side of the fixing apparatus 12 in a conveyance direction of the recording material P (an arrow K direction), a glossiness sensor (fixed toner image detection means) 20 was a glossiness detection means for detecting a glossiness of the toner image after fixation is disposed. The glossiness sensor 20 is connected to a control apparatus (control means) 21 for controlling an operation of the entire image forming apparatus and an image forming condition.

The above described photosensitive drum 1 is formed by disposing a photosensitive layer on an outer peripheral surface of an electroconductive drum support. As the photosensitive layer, a layer of an organic photoconductor (OPC) or amorphous silicone (A-Si) is used. The photosensitive drum 1 is rotationally driven in the arrow R1 direction at a predetermined process speed (peripheral speed) by the unshown drive means.

The charge roller 2 is formed by disposing an elastic layer on an outer peripheral surface of a core metal and is disposed to contact the surface of the photosensitive drum 1. The charge roller 2 is supplied with a charge bias voltage from a charge bias voltage application power source (not shown) to electrically charge uniformly the surface of the photosensitive drum 1 to a predetermined polarity and a predetermined potential.

The exposing apparatus 3 includes a laser oscillator (not shown) for emitting laser light on the basis of image information, a polygon mirror 3*a* and a reflection mirror 3*b*. The laser light emitted from the laser oscillator is incident on the surface of the photosensitive drum 1 through the polygon mirror 3*a* and the reflection mirror 3*b* to perform exposure scanning of the electrically charged surface of the photosensitive drum 1. As a result, electric charges at an exposure portion on the surface of the photosensitive drum 1 are removed to form an electrostatic latent image.

The developing apparatus 4 includes a rotation member (developing cartridge holding member) 4*b* which is rotatably moved around a shaft (axis) 4*a* disposed in parallel with a shaft of the photosensitive drum 1, 5 developing cartridges Dy, Dm, Dc, Db and Dt as developing devices mounted to the rotation member 4*b*, a pressure member 4*c* for pressing one of the developing cartridges to be positioned so that it is disposed opposite to the photosensitive drum 1 by the rotation of the rotation member 4*b*, an unshown drive mechanism for moving the developing cartridges by rotating the rotation member 4*b*, and an unshown holding mechanism for holding the respective developing cartridges in specific positions.

In each of the developing cartridges Dy, Dm, Dc, Db, and Dt, a so-called two component developer using toner and a carrier in combination is contained. The toners contained in the developers for the developing cartridges, Dy, Dm, Dc, Db and Dt are those of yellow (Y), magenta (M), cyan (C), black (B) and transparent (T). Incidentally, hereinafter, the toners for image formation of Y, M, C and B are appropriately referred to as "color toner(s)" in contrast with the toner of transparent (transparent toner) which does not change largely a hue of reflected light from the recording material after being fixed on the recording material. In this embodiment, each of the developing cartridges Dy, Dm, Dc and Db containing the color toners of Y, M, C and B correspond to a first developing device, and the developing cartridge Dt containing the transparent toner corresponds to a second developing device.

The developing apparatus 4 is rotated so that a developing cartridge subjected to development of the electrostatic latent image on the photosensitive drum 1 is located at a developing position opposite to the photosensitive drum 1 by the rotation of the rotation member 4*b*. At this time, a developing bias (voltage) comprising a DC component (developing DC bias) and an AC component (developing AC bias) which are biased with each other is applied to a developing roller 4*d* by a developing bias power source (power supply) 23, whereby the toner in the developer is attached to the electrostatic latent image on the photosensitive drum 1 to develop the latent image as a toner image.

The transfer apparatus 5 includes a cylindrical transfer drum 5*a* as a transfer-receiving member; a gripper 5*b*, disposed on the transfer drum 5*a*, for gripping a leading end portion of the recording material P; an absorption device 5*c* for carrying the recording material P on the surface of the transfer drum 5*a*; a charge removal/separation charger 5*d* and a separation law 5*f* for separating the recording material P, into which the toner image is transferred, from the surface of the transfer drum 5*a*; and a drum cleaner 5*g* for cleaning the surface of the transfer drum 5*a*. Inside the transfer drum 5*a*, a transfer charger (not shown) is disposed at a position corresponding to the photosensitive drum 1 and is supplied with a transfer bias (voltage), whereby the toner image on the photosensitive drum 1 is transferred onto the recording material P on the transfer drum 5*a*.

The cleaning apparatus 6 has a cleaning blade 6*a* disposed to contact the surface of the photosensitive drum 1. By the cleaning blade 6*a*, toner remaining on the surface of the photosensitive drum 1 after the toner image transfer (transfer residual toner) is removed.

Next, an operation of the above constituted image forming apparatus will be explained.

The recording material P accommodated in the paper feeding cassette 10 is fed one by one to the transfer apparatus 5 by the paper feeding roller 11. The fed recording material P is gripped by the gripper 5*b* at its leading end portion and carried on the surface of the transfer drum while being adsorbed thereon by the absorption device 5*c*.

On the other hand, the photosensitive drum 1 is rotationally driven in the arrow R1 direction at the predetermined process speed (peripheral speed) to be electrically charged uniformly to the predetermined polarity and potential at the surface thereof. The charged surface of the photosensitive drum 1 is, e.g., subjected to exposure to light corresponding to a yellow image, whereby an electrostatic latent image for the yellow image is formed. The electrostatic latent image is developed as a yellow toner image by attaching thereto yellow toner by means of the developing cartridge Dy disposed at the developing position located opposite to the photosensitive drum 1 by the rotation of the rotation member 4*b*. The thus formed yellow toner image on the photosensitive drum 1 is transferred onto the recording material P carried on the surface of the transfer drum 5*a* by applying the transfer bias to the transfer charger. The photosensitive drum 1 after the toner image transfer is subjected to removal of the surface transfer residual toner by the cleaning apparatus 6 and is then subjected to subsequent image formation.

The above described respective processes, for the yellow toner image, of charge, exposure, development, transfer, and cleaning, are also performed with respect to a magenta toner image, a cyan toner image, a black toner image, and a transparent toner image. As a result, onto the recording material P carried on the transfer drum 5*a*, the respective color toner images and the transfer toner image are successively transferred in a superposition manner.

The recording material P onto which all the toner images are completely transferred is separated from the surface of the transfer drum 5*a* by the charge removal/separation charger 5*d* and the separation claw 5*f*, and the transfer drum 5*a* from which the recording material P is separated is cleaned by the drum cleaner 5*g*.

The recording material P after the separation is conveyed to the fixing apparatus 12 and is heated and pressed between the fixation roller 12*a* and the pressure roller 12*b*, whereby the toner image is melt-fixed on the surface of the recording material P.

The recording material P after the toner image fixation is discharged on the discharge tray 15 in a face-down manner by the discharge rollers 13 and 14. In the above described manner, color image formation for one sheet of the recording material P is completed.

Incidentally, in the case of outputting the recording material P after the fixation in a face-up manner, the recording material P is discharged on the face-up tray 16 which is placed in an open state from the discharge roller 13 and can be freely opened and closed.

In this embodiment, after the formation of the color toner images (of yellow, magenta, cyan and black), the transparent toner image is formed uniformly on the entire color toner images and then is transferred and fixed on the recording material P. As a result, a difference in glossiness between an image portion (where an image is formed with the color toners) and a non-image portion (other than the image portion) is alleviated, so that it is possible to obtain a high-quality multi-color image.

Herein, the transparent toner has an object of reducing the glossiness difference between the image portion and the non-image portion to achieve a uniform glossiness over the entire image area (the entire surface of the recording material) as a whole and an object of reducing an unevenness of the recording material surface to produce a glossiness thereby to increase the glossiness in the entire image area, in combination.

In order to attain the above objects, there are some methods including a method wherein the transparent toner image is uniformly formed in the entire image area to increase the glossiness in the entire image area and a method wherein such toner that it does not largely change a hue of reflected light from the recording material after being melt-fixed thereon (e.g., white toner having a B-grade tolerance of not more than 6.5 defined by Japan Color Research Institute) is formed at the non-image portion.

In Embodiments 1 to 3, the case of using the former method (the use of transparent toner) is described. However, the present invention is not restricted thereto but embraces the case of using the latter method (the use of white toner).

In the case of using the white toner, with respect to the developing cartridge Dt, the white toner is used in place of the transparent toner and the white toner image is formed on the recording material R in the above described manner. Thereafter, by the fixing device 12, the white toner image is fixed on the recording material P.

Here, an amount of development of each of the color toners of Y, M, C and B is ordinarily controlled in accordance with maximum density control ("Dmax control") in the following manner.

When Dmax control is started, an image density control circuit of a control apparatus 21 (FIG. 1) for controlling the entire image forming apparatus generates an image signal representing a density detection patch from a pattern generation circuit and forms electrostatic latent images for patches P1, P2, P3 and P4 on the photosensitive drum 1 along its rotational direction (the arrow R1 direction).

These electrostatic latent images are formed by the developing apparatus 4 but the respective patches P1 to P4 are changed in developing contrast potential Vcont (a potential difference between an electrostatic latent image on the photosensitive drum 1 and a voltage applied to the developing apparatus 4) so that the patches P1 to P4 has the developing contrasts (potentials) V1 to V4, respectively, satisfying the relationship of V1<V2<V3<V4. The developing contrast potential is specifically determined as a differential value between a drum potential (corresponding to a dark-part potential on the surface of the photosensitive drum 1) and a developing DC bias.

Figure 2:
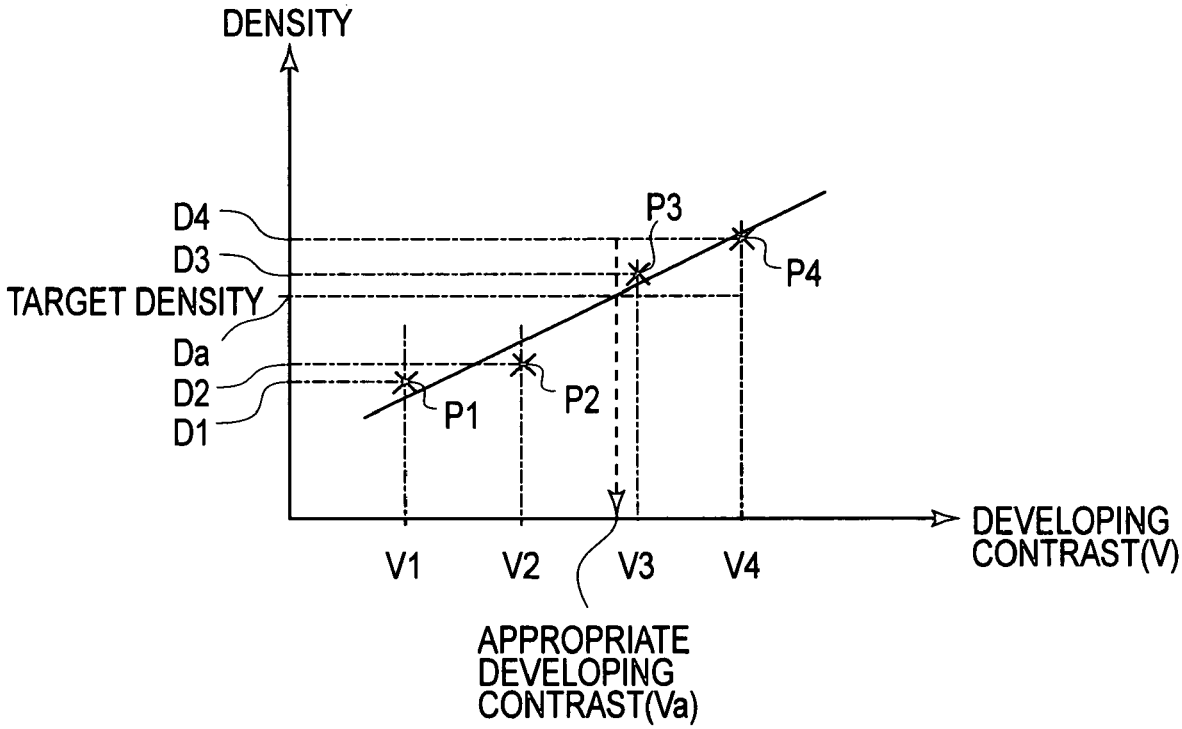
FIG. 2 is a graph showing a relationship between, a developing contrast and an image density.

With respect to the above formed patches P1 to P4 on the photosensitive drum 1, densities thereof. D1 to D4 are measured by a density sensor 22 disposed in the main assembly M of the image forming apparatus, e.g., so as to be opposite to the surfaces of the photosensitive drum 1 and the transfer drum 5. As shown in FIG. 2, four data of the measured densities D1 to D4 for the patches P1 to P4 are plotted and linearized to provide a line representing a relationship between the developing contrast and the density for the patches P1 to P4. An appropriate developing contrast Va is determined as a developing contrast value at a point of intersection of the line and a line representing a target density.

When the transparent toner is subjected to the above described Dmax control similarly as in the color toners, the following problem arises.

One of the objects of the use of the transparent toner is realization of a uniform glossiness by filling the transparent toner itself in the unevenness on the surface of the recording material. For this reason, in the case where the same development amount is used over the entire recording material, depending on a magnitude of the surface unevenness of the recording material, i.e., depending on the kind of the recording material or a lot-to-lot variation of the surface unevenness even when the same kind of recording material is used, a desired gloss (target glossiness) cannot be obtained in some cases.

In this embodiment, this problem is solved in the following manner.

Hereinbelow, control of the development amount of the transparent toner in this embodiment will be described specifically.

In this embodiment, on the recording material P (of the kind) to be outputted, five types of images (patches) different in developing condition is formed with the transparent toner and values of glossiness of the five patches are read by the glossiness sensor 20 disposed downstream of the fixing apparatus 12 along the conveyance direction of the recording material P. The glossiness sensor 20 is disposed so as to detect the glossiness of patch immediately after the fixation. On the bases of output values of the glossiness sensor 20, the control apparatus 20 selects (controls) a developing condition capable of outputting a target glossiness.

With reference to a flow chart of FIG. 3, the control of developing condition in this embodiment will be described more specifically.

First, Dmax control of the transparent toner is started (step S1) and five types of patches T1 to T5 different in developing condition are formed (step S2). These patches T1 to T5 are melt-fixed on a recording material P (of a type) on which image formation is intended to be performed (step S3). As the developing condition, the above described developing contrast is changed four times by 25 V, 100 V in total, to form the 5 patches with the transparent toner. In this embodiment, the developing contrast is changed by changing a laser power of the exposure apparatus 3 (FIG. 1) as described later.

Figure 4:
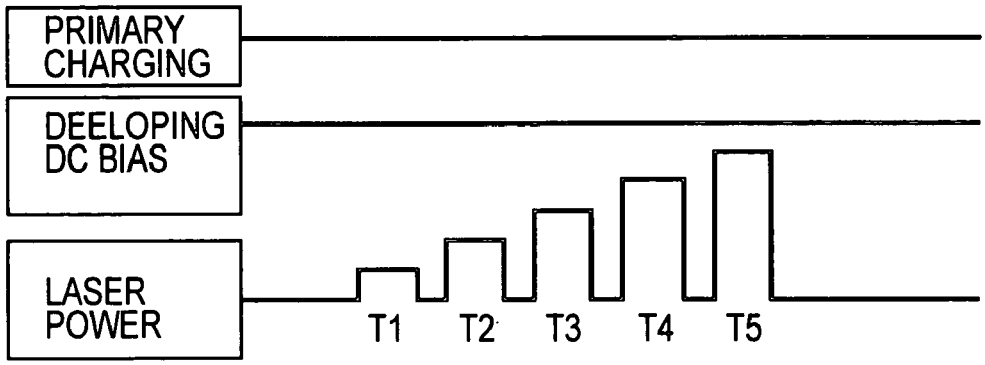
FIG. 4 is a view showing a primary charging potential, a developing DC bias (voltage), and a laser power, in order to form 5 patches different in developing contrast.
Figure 5:
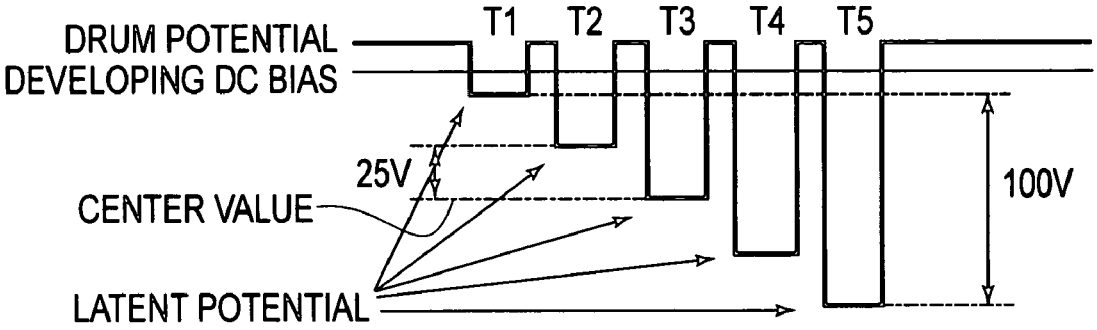
FIG. 5 is a view for explaining a drum potential, a developing DC bias, and a latent image potential, in order to form the 5 patches different in developing contrast.

FIGS. 4 and 5 are views each for illustrating a manner of changing the developing contrast.

As shown in FIG. 4, in this embodiment, the primary charging potential by the transfer roller (charging means) 2 and the developing DC bias by the developing apparatus 4 are controlled at constant levels and on the other hand, the laser paper of the exposure apparatus 3 is changed with respect to the 5 patches T1 to T5, thus forming the five-types of patches T1 to T5 different in developing condition (developing contrast).

FIG. 5 is a view showing the surface potential of the photosensitive drum 1 (drum potential) and the developing contrast at the time of Dmax control in this embodiment. As shown in FIG. 5, with respect to the 5 patches T1 to T5, five-types of developing contrasts are provided by different five latent image potentials (potentials of electrostatic latent images) and the constant developing DC bias (the voltage applied to the developing apparatus 2).

After the 5 patches T1 to T5 formed on the recording material P are melt-fixed, values of glossiness of the patches T1 to T5 are successively read by the glossiness sensor 20 (step S4 in FIG. 3) to provide glossiness data corresponding to the patches T1 to T5.

Figure 6:
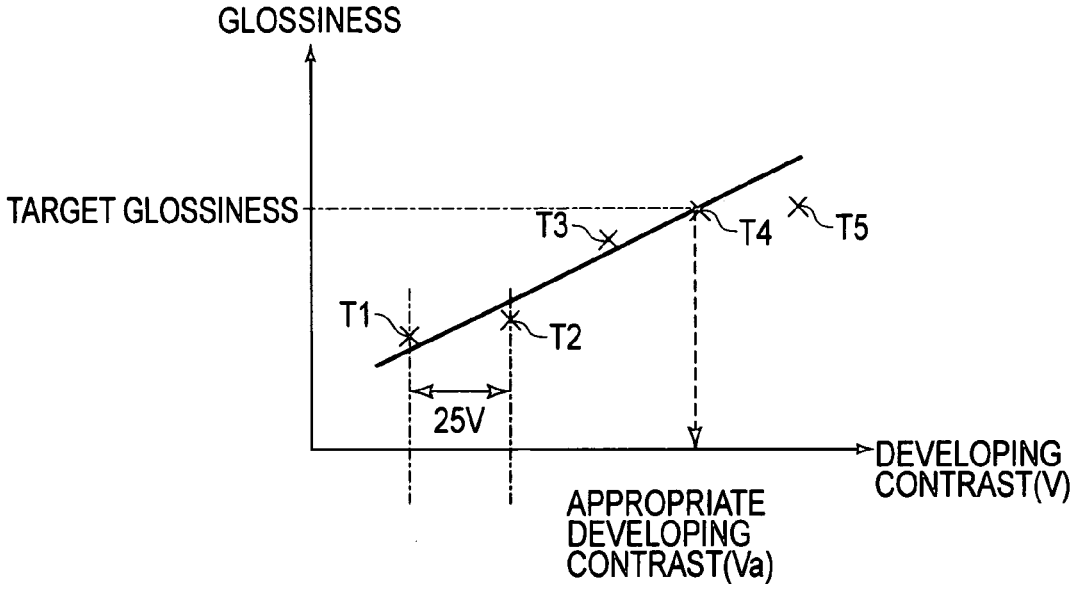
FIG. 6 is a graph showing a relationship, between a developing contrast and a glossiness, from which an appropriate developing contrast for obtaining a target glossiness is determined.

FIG. 6 is a graph for calculating an appropriate developing contrast Va from the glossiness data of the patches T1 to T5 descried above. Referring to FIG. 6, an abscissa represents the developing contrast and an ordinate represents the glossiness detected by the glossiness sensor 20. For example, while taking a currently set developing contrast as a center value, as shown in FIG. 5, five patches T1 to T5 are formed by changing the developing contrast by 25 V for 2 levels on the positive side and for 2 levels on the negative side. Each of the patches T1 to T5 is formed, e.g., in a rectangular shape having a size of 25 mm (in the recording material conveyance direction)×15 mm (in the recording material width direction perpendicular to the conveyance direction). These five patches T1 to T5 are successively formed with a spacing (between adjacent two patches) of 50 mm in the recording material conveyance direction while retaining their positions in the recording material width direction.

The thus formed patches T1 to T5 are increased in development amount of transparent toner in this order, i.e., with an increasing developing contrast. In other words, with the increasing developing contrast, a weight of transparent toner (or white toner) per unit area on the recording material P becomes larger. As the development amount of the transparent toner (or white toner) is increased, an action of reducing the surface unevenness of the recording material P is enhanced, so that a resultant glossiness is increased.

By utilizing such a property, as shown in FIG. 6, it is possible to determine an appropriate developing contrast Va for attaining a target glossiness set in advance.

More specifically, in the case where a glossiness of the toner image of transparent toner or white toner fixed on the recording material P is less than the target glossiness, the control apparatus 21 controls the weight of the transparent toner or white toner per unit area of the recording material P so that it is larger than that in the case where the glossiness of the toner image of transparent toner or white toner fixed on the recording material P is less than the target glossiness.

Further, in the case where a glossiness of the toner image of transparent toner or white toner fixed on the recording material P is less than the target glossiness, the control apparatus 21 controls the weight of the transparent toner or white toner per unit area of the recording material P so that it is equal to that at the time when the glossiness of the toner image of transparent toner or white toner fixed on the recording material P is equal to the target glossiness.

In this embodiment, five sample data are linearized to provide a line (Vcont/glossiness line) (step S5 of FIG. 3), and a value of a developing contrast corresponding to a point of intersection of the Vcont/glossiness line and a line representing the target glossiness is determined as an appropriate developing contrast Va (step S6). The developing contrast is controlled by the control apparatus 21.

In this embodiment, the glossiness sensor as the fixed toner image detection means measures a reflected light amount which is either one of a regular reflection intensity and a diffuse reflection intensity at the time when the recording material P is irradiated with light. Generally, in the case of irradiating the recording material P with light, the light is partially reflected, is partially diffused, and partially passes through the recording material P, depending on the kind of the recording material P and the (development) amount of transparent toner on the recording material P. Of these light fluxes, by measuring the reflected light amount which is either one of the regular and diffuse reflection intensities at the time of irradiating the recording material P with the light, it is possible to identify a difference in glossiness by the amount of the transparent toner on the recording material P. Depending on the information on the reflected light amount, it is possible to control the developing contrast of the transparent toner. It is preferable to use a regular reflection intensity measuring apparatus from the view point of being less affected by a color or a thickness of the recording material P.

In the present invention, the transparent toner refers to toner comprising toner particles which contains no colorant, for coloring through light absorption or light scattering, (such as a coloring pigment, a coloring dye, black carbon particles, black magnetic powder, or the like) and at least comprises a binder resin. The transparent toner used in the present invention is ordinarily transparent and colorless. However, a transparency thereof is somewhat lowered depending on the kind or amount of a plasticizer or a release agent contained in the transparent toner but the resultant toner is substantially transparent and colorless.

As the above described binder resin, it is possible to appropriately select and use any resin depending on a purpose thereof so long as it is substantially transparent. Examples of the binder resin may include generally known toner binder resins, such as polyester-based resins, polystyrene-based resins, polyacrylate-based resin, other vinyl-based resins, polycarbonate-based resins, polyamide-based resins, polyimide-based resins, epoxy-based resins, polyurea-based resins, and their copolymers. Of these resins, the polyester-based resins may preferably be used since they can satisfy toner characteristics such as low-temperature fixability, a fixation strength, and a storability.

As described above, according to this embodiment, it is possible to appropriately select (determine) a developing contrast required to obtain a target glossiness (desired glossiness) by forming a plurality of patches, different in developing contrast, with transparent toner and directly measuring glossiness of these transparent toner patches after fixation, so that it becomes possible to appropriately control an appropriate toner amount, which is different depending on the kind (surface unevenness) of the recording material P, depending on a state of the image forming apparatus on each occasion. As a result, it is possible to stably output a high-quality toner image with a uniform glossiness.

In this embodiment, the control of the toner image forming condition by the control means 21 can be performed during a pre-rotation operation in such a period that a main motor of the image forming apparatus is turned on by inputting a print start signal into the image forming apparatus placed in a stand-by state and a pre-image formation operation of the image forming apparatus is performed for a time. Further, the control sequence may also be executed during a post-rotation operation after completion of image formation on one sheet of the recording material P. Further, the control sequence may also be executed one time per image formation on, e.g., 100 sheets in the case where a large number of sheets of the recording material P are continuously subjected to image formation. It is also possible for a user to control the control means 21 so as to execute the control sequence at the user's own will.

Embodiment 2

In this embodiment, different from Embodiment 1 described above, a glossiness at a portion, where only transparent toner or white toner is used for development, of portions of an outputted image is detected without using patches for detecting a concentration of the transparent toner or white toner, and then a developing contrast is appropriately changed when a change in glossiness is detected. As a result, it is possible to provide a stable glossiness for a long period of time. The portion where only the transparent toner or white toner is used for development is detected by the control apparatus (means) 21 on the basis of image information.

Hereinbelow, this embodiment will be described principally on the basis of a point of difference from Embodiment 1.

When a developing operation is continued by a developing apparatus using two-component developer, a developing characteristic is changed with each passing hour due to imbalance between consumed toner and supplied toner, a charge in amount of triboelectric charge of toner itself, etc. In other words, when a certain developing contrast is kept continuously, the change in developing characteristic manifests itself as a development amount of transparent toner, so that there arises such a problem that the resultant toner image is reduced in glossiness or a toner offset phenomenon at the fixing portion is induced due to an excessive amount of toner.

For this reason, in this embodiment, in the case where a glossiness of the toner image of transparent toner or white toner fixed on the recording material P is less than the target glossiness, the control apparatus 21 controls the developing contrast so that it is larger than that in the case where the glossiness of the toner image of transparent toner or white toner fixed on the recording material P is less than the target glossiness.

Further, in the case where a glossiness of the toner image of transparent toner or white toner fixed on the recording material P is less than the target glossiness, the control apparatus 21 controls the developing contrast so that it is equal to that at the time when the glossiness of the toner image of transparent toner or white toner fixed on the recording material P is equal to the target glossiness.

According to this embodiment, the glossiness at the portion, where only the transparent toner (or white toner) is used for development of portions of the output image is detected and when the glossiness is low, the developing contrast is increased based no a judgement that the development amount of the transparent toner is lowered. On the other hand, when the glossiness is high, the developing contrast is described based on a judgement that the development amount is increased.

Figure 7:
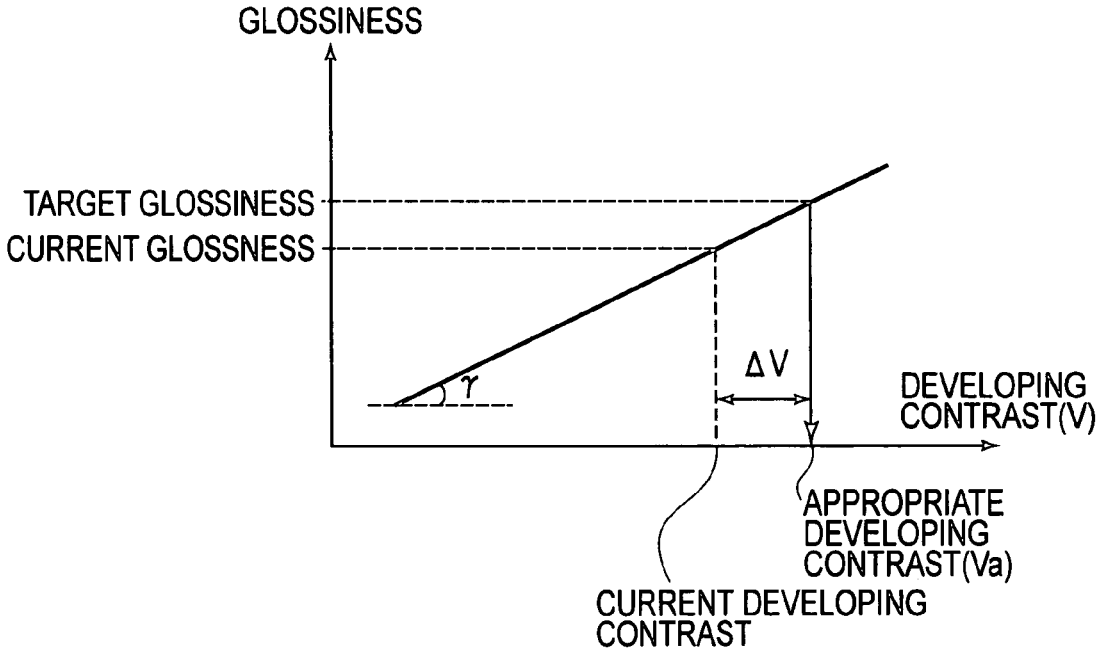
FIG. 7 is a graph showing a relationship between a developing contrast and a glossiness in Embodiment 2, wherein a charge ($\Delta V$) in developing contrast for achieving a target glossiness is determined from a current glossiness, the toner glossiness, and a current developing contrast on the basis of a line representing the relationship.

Referring to FIG. 7, in this embodiment, the glossiness of the outputted image is read during image formation including formation of the transparent toner (image) by reading a portion where only the transparent toner is melt-fixed, i.e., a non-image portion other than an image portion of color toners (of yellow, magenta, cyan and black similarly as in Embodiment 1) by means of the glossiness sensor 21 (FIG. 1). A developing contrast $\Delta V$ which is insufficient (or excessive) to obtain a target glossiness is calculated from the read glossiness, a set developing contrast, and a slope $\gamma$ of a line representing a relationship between a developing contrast and glossiness. The calculated developing contrast $\Delta V$ is added to a current developing contrast to provide a new (appropriate) developing contrast Va, thus effecting development with the transparent toner.

According to this embodiment, it is possible to make fine adjustment of the developing contrast in order to provide a glossiness close to the target glossiness while reading the current glossiness in real time, so that it becomes possible to quickly obtain an appropriate glossiness without causing downtime for adjusting the developing contrast.

The above described slope $\gamma$ (glossiness/developing contrast) may be determined by using a result of a previous Dmax control or by inputting an appropriate value in the control apparatus 21 (FIG. 1) in advance. Further, the user may appropriately input a value of the slope $\gamma$ depending on the kind of the recording material.

Embodiment 3

In this embodiment, different from Embodiment 1 described above, a glossiness at a portion, where only transparent toner is used for development, of portions of an outputted image is detected without using patches for detecting a concentration of the transparent toner, and then a supply amount of the transparent toner is appropriately changed when a change in glossiness is detected. As a result, it is possible to provide a stable glossiness for a long period of time.

Hereinbelow, this embodiment will be described principally on the basis of a point of difference from Embodiments 1 and 2 while omitting repetitive explanation.

In two-component development, an unshown toner supply means for supplying fresh toner in order to compensate consumed toner is used to supply toner.

However, as described above, a charge in amount of triboelectric charge of toner is caused to occur due to the imbalance between the consumed toner and the supplied toner to change a developing characteristic. As a result, there arises such a problem that an image density (a weight of the toner per unit area) fluctuates. This is attributable to such a phenomenon that a triboelectric charge amount of the toner is decreased when a weight ratio of toner to developer (the toner and a caffier) ("TD ratio") is increased and is increased when the TD ratio is decreased. This phenomenon is one of the factors causing the change in developing characteristic.

According to this embodiment, the glossiness at the portion, where only the transparent toner is used for development of portions of the output image is detected and when the glossiness is low, the toner supply amount is increased based no a judgement that the triboelectric charge amount of the toner is increased to decrease the developing performance. On the other hand, when the glossiness is high, the toner supply amount is described based on a judgement that the triboelectric charge amount of the toner is decreased to increase the developing performance.

More specifically, in this embodiment, in the case where a glossiness of the toner image of transparent toner or white toner fixed on the recording material P is less than the target glossiness, the control apparatus 21 controls a ratio of the weight of the toner to the weight of the carrier so that it is larger than that in the case where the glossiness of the toner image of transparent toner (or white toner) fixed on the recording material P is less than the target glossiness.

Further, in the case where a glossiness of the toner image of transparent toner (or white toner) fixed on the recording material P is less than the target glossiness, the control apparatus 21 controls the ratio of weight of the toner to the weight of the carrier so that it is equal to that at the time when the glossiness of the toner image of transparent toner (or white toner) fixed on the recording material P is equal to the target glossiness.

Figure 8:
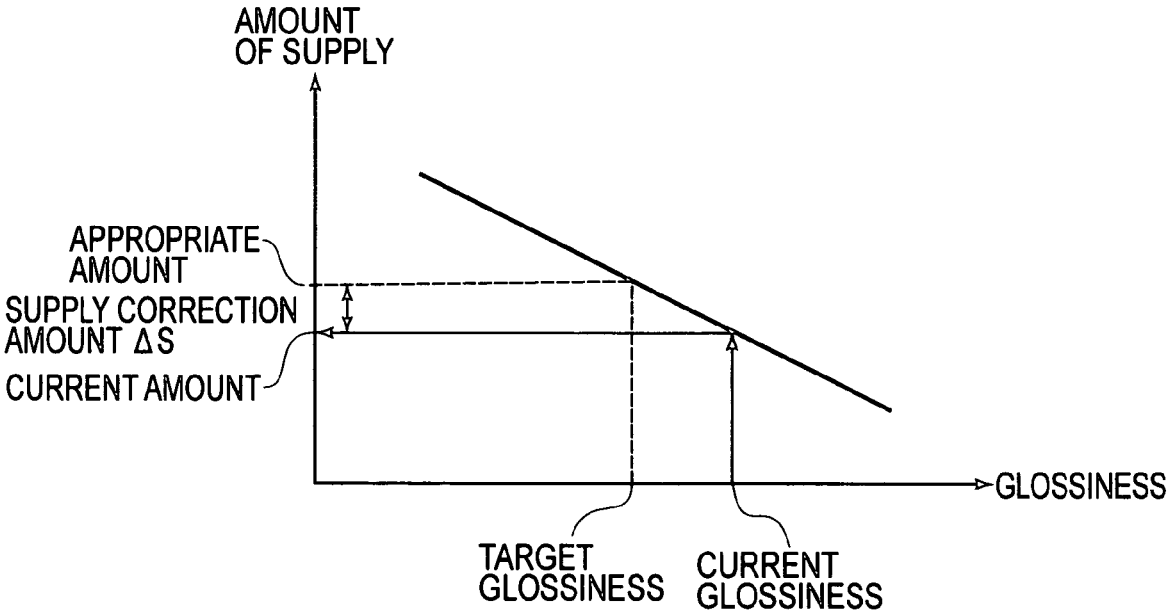
FIG. 8 is a graph showing a relationship between a glossiness and a supply amount of toner in Embodiment 3, wherein a supply correction amount ($\Delta S$) of a toner supply amount for achieving a target glossiness is determined from a current glossiness, the target glossiness, and a current supply amount of toner on the basis of a line representing the relationship.

In this embodiment, the glossiness of the outputted image is read during image formation including formation of the transparent toner (image) by reading a portion where only the transparent toner is melt-fixed, i.e., a non-image portion other than an image portion of color toners (of yellow, magenta, cyan and black similarly as in Embodiment 1) by means of the glossiness sensor 21 (FIG. 1). Then, in accordance with a relationship between a glossiness and a toner supply amount shown in FIG. 8, the read glossiness is compared with a target glossiness to calculate a supply correction amount ΔS. To a current supply amount, the supply correction amount ΔS is added, thus providing an appropriate supply amount of transparent toner. The appropriate supply amount of transparent toner is supplied, thus controlling the tone supply amount in real time. As a result, it becomes possible to quickly obtain an appropriate (target) glossiness without causing particular downtime for adjusting the toner supply amount.

In Embodiments 1 to 3 described above, the description is made with respect to the image forming apparatus shown in FIG. 1 to which the present invention is applied as an example. However, the present invention is not limited thereto but may be applicable to any image forming apparatus so long as it is capable of forming a toner image on a recording material through development, transfer, and fixation and capable of controlling a developing condition. For example, the present invention is also applicable to, e.g., image forming apparatuses such as a white/black image forming apparatus, a color image forming apparatus using an intermediate transfer member (such as intermediary transfer belt, intermediary transfer drum, or the like), and a so-called tandem-type image forming apparatus including a plurality of image forming units each having a photosensitive drum. In the case of applying the present invention to these image forming apparatuses, it is possible to achieve the similar effects as described above.

In the above described embodiments, by uniformly performing development with transparent toner or white toner at the non-image portion other than the image portion (where the image is formed with the color toners), it is also possible to provide a substantially uniform gloss over the entire image area. This is because the image portion originally has a gloss to some extent by melt-fixation of the color toners (of Y, M, C and B) and the non-image portion is increased in glossiness with the transparent toner or white toner to alleviate a difference in glossiness between the image portion and the non-image portion.

In the above described Embodiments 2 and 3, the control sequence may be executed every image formation on one sheet of the recording material P. Further, the control sequence may also be executed one time per image formation on, e.g., 100 sheets in the case where a large number of sheets of the recording material P are continuously subjected to image formation. It is also possible for a user to control the control means 21 so as to execute the control sequence at the user's own will.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 091627/2004 filed Mar. 26, 2004, which is hereby incorporated by reference.

What is claimed is:

1. An image forming apparatus, comprising:

toner image forming means for forming a toner image on a recording material with transparent or white toner, fixing means for fixing the toner image on the recording material, fixed toner image detection means for detecting the toner image fixed on the recording material; and control means for variably controlling a toner image forming condition of said toner image forming means on the basis of a detection result of said fixed toner image detection means, wherein said fixed toner image detection means detects a glossiness of the toner image, wherein the toner image forming condition variably controlled by said control means is a weight of the toner per unit area of the toner image on the recording material.

2. An apparatus according to claim 1, wherein when the glossiness of the toner image detected by said fixed toner image detection means is less than a predetermined glossiness, said control means controls the weight of the toner per unit area of the toner image on the recording material so that it is larger than that when the detected glossiness of the toner image is less than the predetermined glossiness.

3. An apparatus according to claim 1, wherein when the glossiness of the toner image detected by said fixed toner image detection means is less than a predetermined glossiness, and wherein said control means controls the weight of the toner per unit area of the toner image on the recording material so that it is equal to that when the detected glossiness of the toner image is equal to the predetermined glossiness.

4. An apparatus according to claim 3, wherein said toner image forming means includes an image bearing member, electrostatic latent image forming means for forming an electrostatic latent image on said image bearing member, and developing means for developing the electrostatic latent image with toner by applying a voltage from a power source thereto, and wherein said control means variably controls a potential difference between an electric potential of the electrostatic latent image on said image bearing member and the voltage applied to said developing means.

5. An apparatus according to claim 4, wherein when the glossiness of the toner image detected by said fixed toner image detection means is less than a predetermined glossiness, and wherein said control means controls the potential difference so that it is larger than that when the detected glossiness of the toner image is less than the predetermined glossiness.

6. An apparatus according to claim 4, wherein when the glossiness of the toner image detected by said fixed toner image detection means is less than a predetermined glossiness, said control means controls the potential difference so that it is equal to that when the detected glossiness of the toner image is equal to the predetermined glossiness.

7. An apparatus according to claim 3, wherein said toner image forming means includes an image bearing member; an electrostatic latent image forming means for forming an electrostatic latent image on said image bearing member; and developing apparatus, comprising the toner and a carrier, for developing the electrostatic latent image with the toner, and wherein said control means variably controls a ratio of a weight of the toner to a weight of the carrier in said developing apparatus.

8. An apparatus according to claim 7, wherein when the glossiness of the toner image detected by said fixed toner image detection means is less than a predetermined glossiness, said control means controls the ratio of the weight of the toner to the weight of the carrier so that it is larger than that when the detected glossiness of the toner image is less than the predetermined glossiness.

9. An apparatus according to claim 7, wherein when the glossiness of the toner image detected by said fixed toner image detection means is less than a predetermined glossiness, said control means controls the ratio of the weight of the toner to the weight of the carrier so that it is equal to that when the detected glossiness of the toner image is equal to the predetermined glossiness.

* * * * *

UNITED STATES PATENT AND TRADEMARK OFFICE

CERTIFICATE OF CORRECTION

PATENT NO. : 7,245,843 B2
APPLICATION NO. : 11/085558
DATED : July 17, 2007
INVENTOR(S) : Yuji Bessho It is certified that error appears in the above-identified patent and that said Letters Patent is hereby corrected as shown below:

IN THE DRAWINGS

Figure 3:
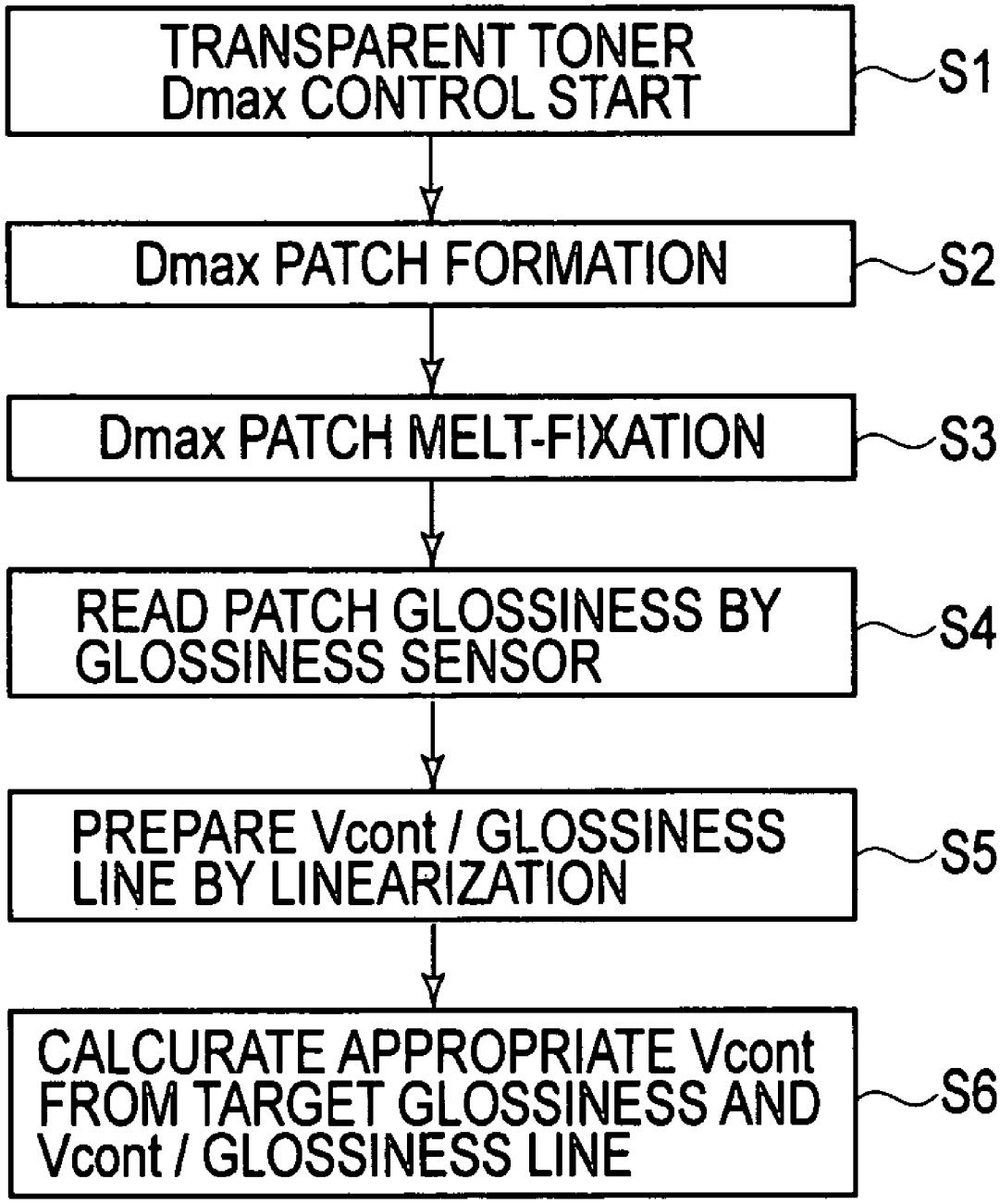
FIG. 3 is a flow chart for explaining such a control that an appropriate developing contrast for achieving a target glossiness is obtained.

Sheet 3, Fig. 3, “CALCURATE” should read --CALCULATE--.
Sheet 4, Fig. 5, “DEELOPING” should read --DEVELOPING--.

COLUMN 1

Line 28, “has accompanied” should read --has been accompanied--;
Line 62, “between,” should read --between--.

COLUMN 3

Line 39, “was a glossiness” should read --has a glossiness--.

COLUMN 4

Line 50, “separation law 5f” should read --separation claw 5f--.

COLUMN 6

Line 39, “P1 to P4 has “ should read --P1 to P4 have --;
Line 47, “thereof.” should read --thereof--.

COLUMN 7

Line 13, “is formed” should read --are formed--;
Line 43, “five-types” should read --five types--;
Line 50, “five-types” should read --five types--; and “different” should read --five different--;
Line 51, “five” should be deleted.

COLUMN 10

Line 34, “based no” should read --based on--.

UNITED STATES PATENT AND TRADEMARK OFFICE

CERTIFICATE OF CORRECTION

PATENT NO. : 7,245,843 B2
APPLICATION NO. : 11/085558
DATED : July 17, 2007
INVENTOR(S) : Yuji Bessho It is certified that error appears in the above-identified patent and that said Letters Patent is hereby corrected as shown below:

COLUMN 11

Line 26, “a caffier)” should read --a carrier)--;
Line 33, “based no” should read --based on--.

COLUMN 12

Line 2, “tone supply” should read --toner supply--.

Signed and Sealed this

Twenty Second Day of April, 2008

JON W. DUDAS
*Director of the United States Patent and Trademark Office*